US009016384B2

(12) United States Patent
Xu et al.

(10) Patent No.: US 9,016,384 B2
(45) Date of Patent: Apr. 28, 2015

(54) DISINTEGRABLE CENTRALIZER

(75) Inventors: YingQing Xu, Tomball, TX (US); Zhiyue Xu, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 211 days.

(21) Appl. No.: 13/525,800

(22) Filed: Jun. 18, 2012

(65) Prior Publication Data

US 2013/0333899 A1 Dec. 19, 2013

(51) Int. Cl.
*E21B 17/10* (2006.01)
*E21B 29/06* (2006.01)

(52) U.S. Cl.
CPC ..... *E21B 17/1007* (2013.01); *E21B 29/06* (2013.01)

(58) Field of Classification Search
USPC ..... 166/376, 241.1, 381, 255.3, 55.3, 196; 175/57
See application file for complete search history.

(56) References Cited

U.S. PATENT DOCUMENTS

| | | | |
|---|---|---|---|
| 5,765,640 | A | 6/1998 | Milne et al. |
| 7,559,371 | B2 | 7/2009 | Lynde et al. |
| 2008/0115972 | A1 | 5/2008 | Lynde et al. |
| 2008/0190602 | A1 | 8/2008 | Palmer |
| 2009/0071641 | A1 | 3/2009 | Gaudette et al. |
| 2010/0084144 | A1 | 4/2010 | Vaeth et al. |
| 2011/0132143 | A1 | 6/2011 | Xu et al. |
| 2011/0135530 | A1 | 6/2011 | Xu et al. |
| 2013/0047784 | A1 | 2/2013 | Xu |
| 2013/0052472 | A1 | 2/2013 | Xu |
| 2013/0186647 | A1 | 7/2013 | Xu et al. |

OTHER PUBLICATIONS

International Search Report and Written Opinion, International Application No. PCT/US2013/041380, International filed: May 16, 2013; Date of Mailing: Jul. 26, 2013; 12 pages.

Well Flow International, [online]; [retrieved on Jun. 18, 2012]; retrieved from the Internet http://www.well-flow.com/welded_centralizers.html, "Bow Spring Centralizers," Copyright © 2007-2008 Well Flow International LLC, 1p.

*Primary Examiner* — David Bagnell
*Assistant Examiner* — Taras P Bemko
(74) *Attorney, Agent, or Firm* — Cantor Colburn LLP

(57) ABSTRACT

A system including a first component, a second component disposed radially adjacent to the first component, and a centralizer disposed between the first component and the second component for at least partially filling a radial clearance between the first component and the second component. The centralizer is formed at least partially from a disintegrable material responsive to a selected fluid. A method of completing a borehole is also included.

9 Claims, 7 Drawing Sheets

DISINTEGRABLE CENTRALIZER

BACKGROUND

Centralizers are used in the downhole drilling and completions industry for stabilizing components, maintaining concentricity or alignment, etc. One particular example involves using a centralizer during a window milling operation in order to guide the mill and to subsequently stabilize the mill as it is directed through the wall of an outer tubular in order to produce a deviated section of a borehole. This scenario is discussed, for example, in U.S. Pat. No. 7,559,371 (Lynde et al.), which Patent is hereby incorporated by reference in its entity. While such systems work sufficiently for their desired purposes, centralizers can interfere with subsequent operations, activities, production, etc., and physical removal of the centralizers, e.g., by fishing or intervention, can be difficult, costly, and time consuming. The industry is always desirous of alternatives in centralizer technology, particularly in designs that enable the centralizer to be selectively removed in order to facilitate subsequent operations.

SUMMARY

A system including a first component, a second component disposed radially adjacent to the first component; and a centralizer disposed between the first component and the second component for at least partially filling a radial clearance between the first component and the second component, the centralizer formed at least partially from a disintegrable material responsive to a selected fluid.

A centralizer, including a metal composite including a cellular nanomatrix comprising a metallic nanomatrix material; a metal matrix disposed in the cellular nanomatrix; and a disintegration agent.

A method of completing a borehole including disposing a centralizer between a first component and a second component for reducing a radial gap between the first and second components; and disintegrating the centralizer by exposure to a selected fluid.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

As will be discussed with respect to various particular embodiments below, the current invention as claimed advantageously provides a centralizer for maintaining alignment between two radially adjacent components, e.g., for maintaining concentricity between inner and outer tubulars. It is to be appreciated that the term centralizer is used with respect to the axes or locations with or about which each component is desired to be centered, and that these axes need not be concentric (e.g., the first component could be desired to be centered along a first axis, the second component about a second axis, and the two axes could be non-concentrically arranged). Advantageously, the centralizers according to the current invention are at least partially made from a material that is disintegrable in response to one or more selected fluids. Generally, as used herein, "disintegrable" refers to a material or component that is consumable, corrodible, degradable, dissolvable, weakenable, or otherwise removable, and any other form of "disintegrate" shall incorporate this meaning. Fluids in the downhole drilling and completions industry include natural borehole fluids such as water, brine, oil, etc. or fluids added or pumped into the borehole for the specific purpose of disintegrating the material. Examples of particularly beneficial disintegrable materials include so-called controlled electrolytic metallic materials, which are discussed in more detail below. Benefits of controlled electrolytic materials include tailorability of the disintegration rate, ductility, and strength, among other properties.

Window milling operations represent one type of situation that benefits from a removable centralizer, as the mills need to be supported or stabilized by the centralizer temporarily, and after the milling is complete, the mill is removed and the centralizer no longer needed. For ease of discussion, the particular embodiments discussed below are with respect to such milling operations, although one of ordinary skill in the art will readily appreciate other operations may also benefit from a "disappearing" centralizer. In order to be used in these milling operations, the centralizers discussed below also must be able to be installed in a first shape or set of dimensions, e.g., to fit through a restriction during run-in, and then expand radially to a second shape or set of dimensions, e.g., to minimize radial clearance between the inner and outer components and provide improved centralization/stabilization. Of course, centralizers that can transition from one set of dimensions to another set of dimensions also have applications other than window milling operations and again, this is given as one example only.

DETAILED DESCRIPTION

Figure 1:
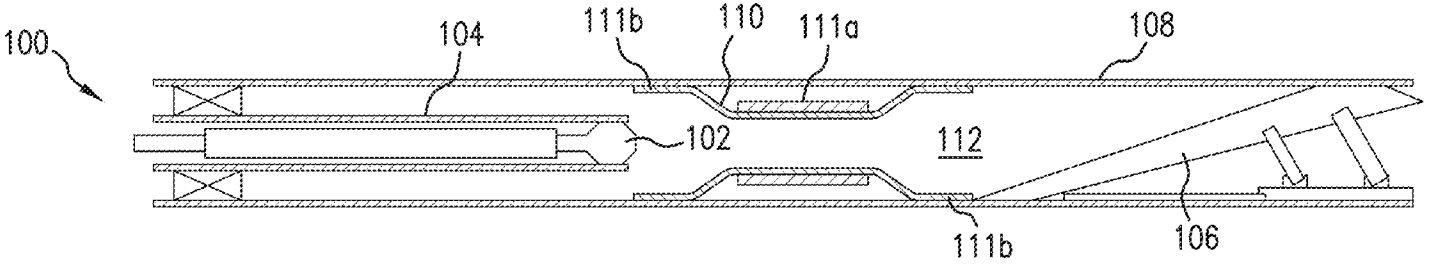
FIG. 1 is a cross-sectional view of a milling system having a centralizer according to one embodiment disclosed herein.
Figure 1A:
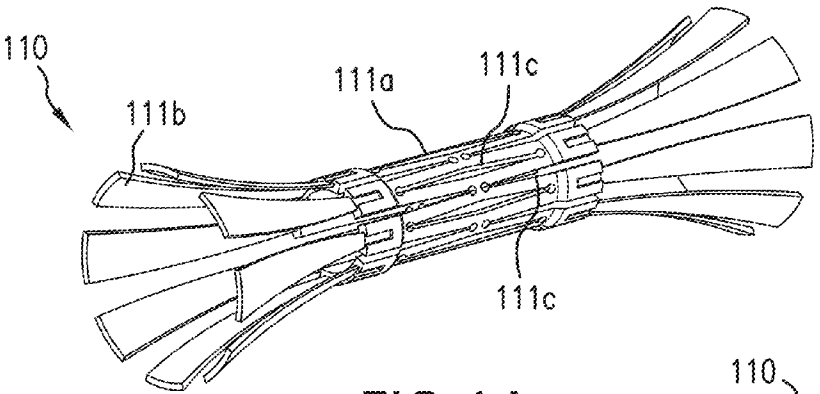
FIG. 1A illustrates a centralizer for the system of FIG. 1 according to one embodiment disclosed herein.
Figure 1B:
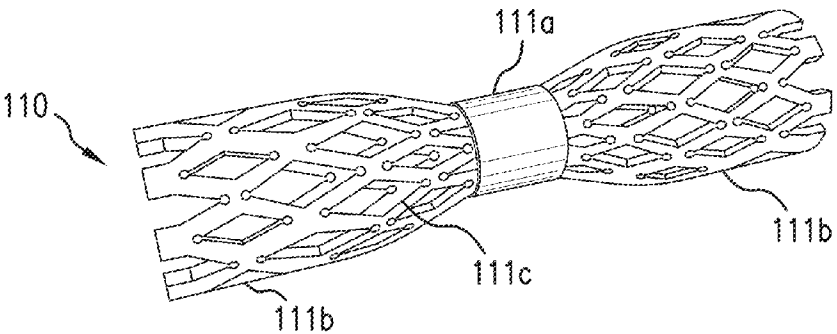
FIG. 1B illustrates a centralizer for the system of FIG. 1 according to another embodiment disclosed herein.

Referring now to FIG. 1, a milling system 100 is shown having a mill 102 runnable through a work string 104 in order to engage a whipstock 106. In known fashion, the whipstock 106 includes a ramp that redirects the mill 102 into a wall of an outer tubular 108, e.g., a casing or tubing in a borehole. The system 100 includes a centralizer 110 to maintain the concentricity of the mill 102 within the outer tubular 108 or to otherwise reduce vibrations, guide, stabilize, etc. For example, the centralizer 110 may first be used to ensure the mill 102 encounters the ramp of the whipstock 106, and then to reduce vibration of the mill 102 as it cuts a window in the outer tubular 108. The centralizer 110 in the embodiment of FIG. 1 is arranged so that it is generally spring-like or resilient and installed by passing the centralizer 110 in a compressed state through the work string 104 before inserting the mill 102. Upon exiting the work string 104, the centralizer 110 automatically and resiliently springs open toward its natural, uncompressed state, thereby taking a second set of dimensions that are radially expanded with respect to a first set defining the aforementioned compressed state. In general, the centralizer 110 has a relatively restricted body portion 111*a*, e.g., for providing support against the mill 102 and resiliently expandable end portions 111*b*, e.g., for providing support against the outer tubular 108. Examples of geometries for the centralizer 110 that enable such resiliency are provided in FIGS. 1A and 1B, in which it can be seen that the end portions 111*b* can resiliently spring radially outward and/or compress radially inward due to the presence of openings, slits, or cuts, generally designated with the reference numeral 111*c*. Of course, it is to be appreciated that any other shape or geometry that enables the centralizer 110 to be radially compressed and then resiliently expanded could be similarly used.

The centralizer 110 is formed from a disintegrable material. In this way, exposure of the centralizer 110 to selected fluids, e.g., brine or other downhole fluids, will result in removal of the centralizer 110 after some period of time. Thus, the centralizer 110 will initially be present for guiding and stabilizing the mill 102 as the mill 102 cuts a window in the outer tubular or structure 108, but the centralizer 110 will thereafter be disintegrated. By degrading the centralizer 110, an internal passageway 112 through the tubular 108 is opened, e.g., for enabling more efficient production through the passageway 112, the passage of equipment, plugs, balls, etc. through the passageway 112, the performance of operations that would otherwise be impeded by the presence of the centralizer 110, etc., while avoiding the need to undergo extensive and time consuming processes to physically or manually remove the centralizer 110.

Figure 2:
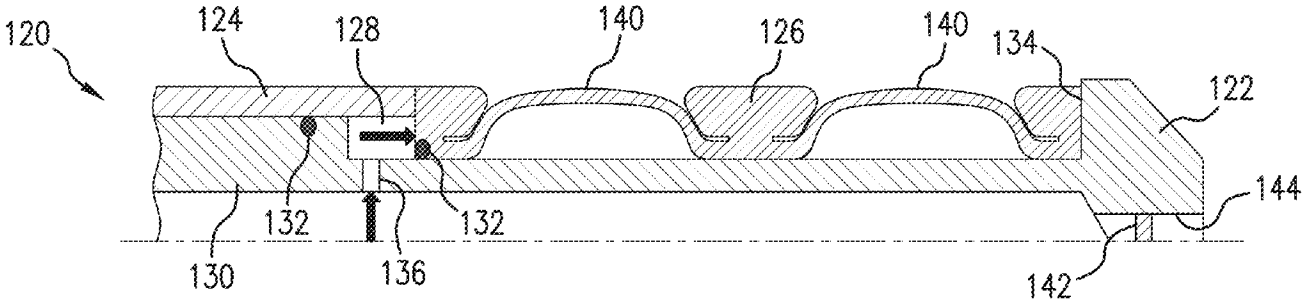
FIG. 2 is a quarter-sectional view of a milling system having a centralizer according to another embodiment disclosed herein.
Figure 3:
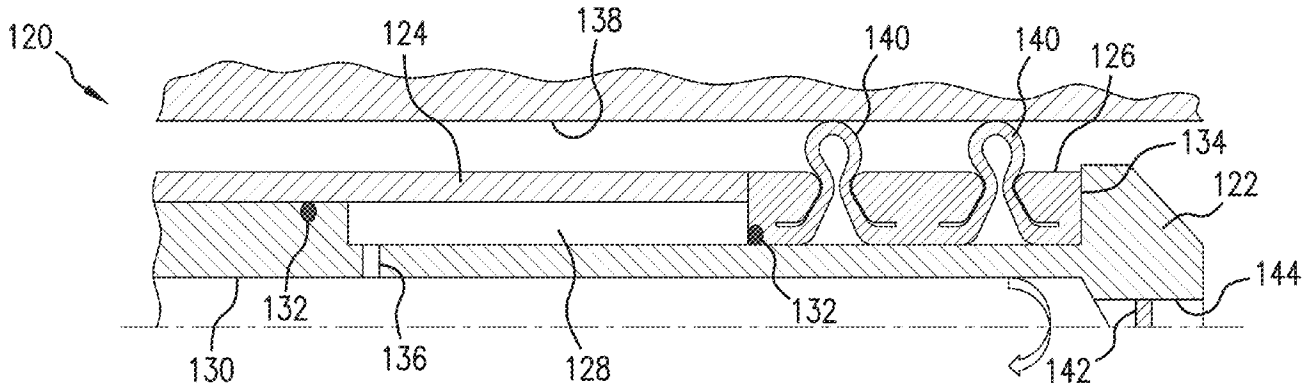
FIG. 3 is a quarter-sectional view of the milling system of FIG. 2 with the centralizer in a deployed state.

A system 120 according to another embodiment is shown in FIGS. 2 and 3. Specifically, the system 120 includes a mill 122 that is run in with a sleeve 124 and a deformable centralizer 126. The mill 122, the sleeve 124, and the centralizer 126 may initially be run-in through a work string, e.g., the work string 104. The centralizer 126 is shown in FIG. 2 in an initial shape having relatively radially compressed, but axially elongated dimensions than the deployed shape of FIG. 3.

A chamber 128 formed between the sleeve 124 and a string 130 of the mill 122 is pressurizable in order to transition the centralizer 126 between the shapes shown in FIGS. 2 and 3. Specially, the sleeve 124 and the centralizer 126 are sealed with respect to the string 130, e.g., via seal elements 132, to maintain an actuation pressure in the chamber 128. The actuation pressure compresses the centralizer 126 axially against a shoulder 134 of the mill 122. The chamber 128 can be pressurized, for example, by pumping a fluid down through the string 130 and into the chamber 128 via an inlet 136.

The centralizer 126 is shown in its deformed state in FIG. 3, in which it takes a second shape or set of dimensions that enable the centralizer 126 to at least partially fill the radial clearance or gap between the mill 122 and an outer structure 138, e.g., a borehole casing. Specifically, one or more deformable elements or bridges 140 of the centralizer 126 are radially extended due to the axial compression of the centralizer 126. Although two of the deformable elements 140 are shown, it is to be appreciated that the centralizer 126 can include any number of the deformable elements 140 to provide any level of desired support of the mill 122 against the outer structure 138. The centralizer 126 could include any radially or axially oriented openings, bores, slots, slits, folds, etc. for reducing the amount of material that must be deformed, and therefore the pressure necessary to extend the elements 140.

It is to be appreciated that the sleeve 124 could be alternatively actuated in some other way, e.g., via an actuator that is mechanical, electrical, magnetic, etc. (or combinations thereof), in order to axially compress the centralizer 126 and radially extend the deformable elements 140. In one embodiment, a selective plug member 142, such as a rupture disc, plug held by a screw, collet, or other release member, etc. could be included in a passage 144 (or passages) in the mill 122 leading to the cutting surfaces of the mill 122. In this way, by pressurizing within the mill 122 to a selected level, e.g., a level greater than that required to radially extend the centralizer 126, the plug 142 is ruptured or removed and the passage 144 becomes unblocked so that the cutting surfaces of the mill 122 can be cooled during milling, cuttings washed away, etc.

As discussed above, the centralizer 126 is formed from a disintegrable material so that after the mill 122 is initially supported, e.g., while forming a window in the outer structure 138, the centralizer 126 "disappears" or is removed due to disintegration of the centralizer 126 upon contact with a selected fluid, e.g., brine, oil, etc. In addition to removing the centralizer 126 via disintegration, it is also to be noted that the shoulder 134 of the mill 122 could be a cutting surface, so that the mill 122 can be pulled out at any time by milling out the centralizer 126 with the shoulder 134. In this scenario, milling will be facilitated because the centralizer 126 is at least partially weakened upon contact with the selected fluid, and further, any chunks or portions of the centralizer 126 remaining in the structure 138 after removal of the mill 122 will disintegrate over time and thus not prevent subsequent operations in the structure 138.

Figure 4:
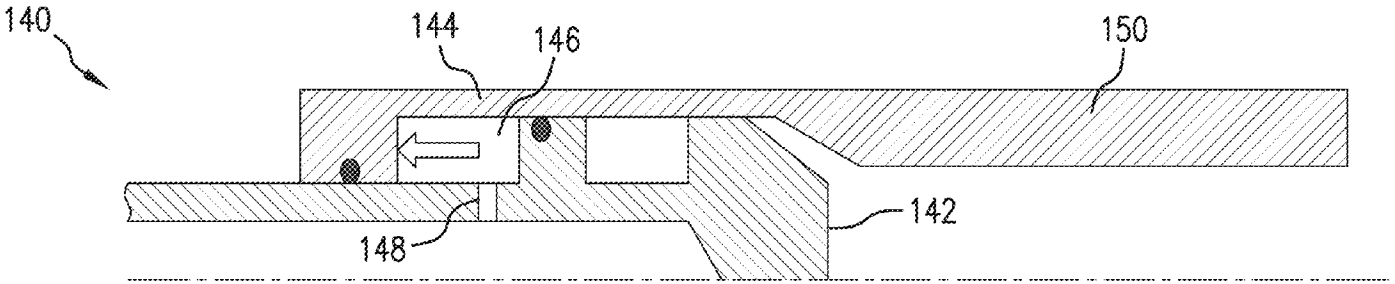
FIG. 4 is a quarter-sectional view of a milling system having a centralizer according to another embodiment disclosed herein.
Figure 5:
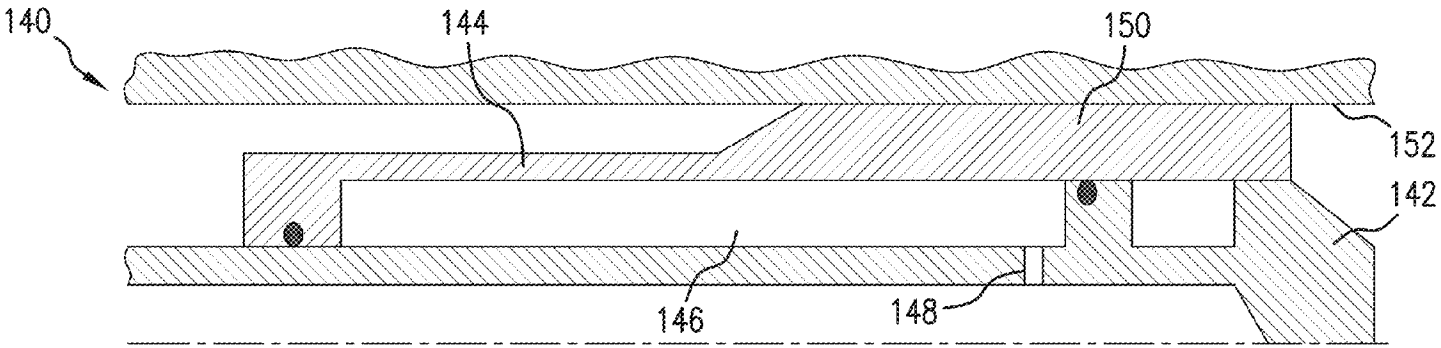
FIG. 5 is a quarter-sectional view of the milling system of FIG. 4 with the centralizer in a deployed state.

A system 140 according to another embodiment is shown in FIGS. 4-5. The system 140 includes a mill 142 that is disposed with a sleeve 144. Similar to the system 120, the mill 142 and the sleeve 144 form a chamber 146 therebetween, which is, for example, pressurizable by pumping a fluid through the mill 142 and into the chamber 146 via an inlet 148. In this embodiment, pressurizing the chamber 146 results in relative movement between the mill 142 and the sleeve 144. This in turn causes the mill 142 to act essentially as a swage to deform a centralizer 150 included with the sleeve 144. The centralizer 150 could be integrally formed with the sleeve 144 or be otherwise secured thereto to support the centralizer 150 during the swaging process. It should be appreciated, as noted above, that the pressurizable chamber 146 could be replaced by some other actuator or the mill 142 actuated in some over way to swage the centralizer 150. When deformed, as shown in FIG. 5, the centralizer 150 has a second set of radially enlarged dimensions that enables it to at least partially fill a greater amount of the radial clearance between the mill 142 and an outer structure 152, e.g., an outer tubing, casing, tubular, etc. The centralizer 150 could include any radially or axially oriented openings, bores, slots, slits, folds, etc. for reducing the amount of material that must be deformed, and therefore the pressure necessary to swage the centralizer 150. The mill 142 could be provided with a rupture disc or similar mechanism for selectively enabling fluid flow to the cutting surfaces of the mill 142 as discussed above.

The centralizer 150 is formed at least partially from a disintegrable material so that after initially providing a centralizing/stabilizing function, e.g., supporting the mill 142 as it cuts a window in the outer structure 152, the centralizer 150 disintegrates. In this way, the centralizer 150 ceases to impede subsequent activities or operations in the structure 152, such as production, passing equipment, tools, or materials downhole, etc.

Materials appropriate for the purpose of degradable protective layers as described herein are lightweight, high-strength metallic materials. Examples of suitable materials and their methods of manufacture are given in United States Patent Publication No. 2011/0135953 (Xu, et al.), which Patent Publication is hereby incorporated by reference in its entirety. These lightweight, high-strength and selectably and controllably degradable materials include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in borehole applications. Suitable core materials include electrochemically active metals having a standard oxidation potential greater than or equal to that of Zn, including as Mg, Al, Mn or Zn or alloys or combinations thereof. For example, tertiary Mg—Al—X alloys may include, by weight, up to about 85% Mg, up to about 15% Al and up to about 5% X, where X is another material. The core material may also include a rare earth element such as Sc, Y, La, Ce, Pr, Nd or Er, or a combination of rare earth elements. In other embodiments, the materials could include other metals having a standard oxidation potential less than that of Zn. Also, suitable non-metallic materials include ceramics, glasses (e.g., hollow glass microspheres), carbon, or a combination thereof. In one embodiment, the material has a substantially uniform average thickness between dispersed particles of about 50 nm to about 5000 nm. In one embodiment, the coating layers are formed from Al, Ni, W or $Al_2O_3$, or combinations thereof. In one embodiment, the coating is a multi-layer coating, for example, comprising a first Al layer, a $Al_2O_3$ layer, and a second Al layer. In some embodiments, the coating may have a thickness of about 25 nm to about 2500 nm.

These powder compacts provide a unique and advantageous combination of mechanical strength properties, such as compression and shear strength, low density and selectable and controllable corrosion properties, particularly rapid and controlled dissolution in various borehole fluids. The fluids may include any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$). For example, the particle core and coating layers of these powders may be selected to provide sintered powder compacts suitable for use as high strength engineered materials having a compressive strength and shear strength comparable to various other engineered materials, including carbon, stainless and alloy steels, but which also have a low density comparable to various polymers, elastomers, low-density porous ceramics and composite materials.

In one embodiment, the disintegrable material is a metal composite that includes a metal matrix disposed in a cellular nanomatrix and a disintegration agent. In an embodiment, the disintegration agent is disposed in the metal matrix. In another embodiment, the disintegration agent is disposed external to the metal matrix. In yet another embodiment, the disintegration agent is disposed in the metal matrix as well as external to the metal matrix. The metal composite also includes the cellular nanomatrix that comprises a metallic nanomatrix material. The disintegration agent can be disposed in the cellular nanomatrix among the metallic nanomatrix material. An exemplary metal composite and method used to make the metal composite are disclosed in U.S. publications 20110132143, 20110135530, 20130052472, 20130047784, and 20130186647, the disclosure of each of which patent application is incorporated herein by reference in its entirety.

Figure 6:
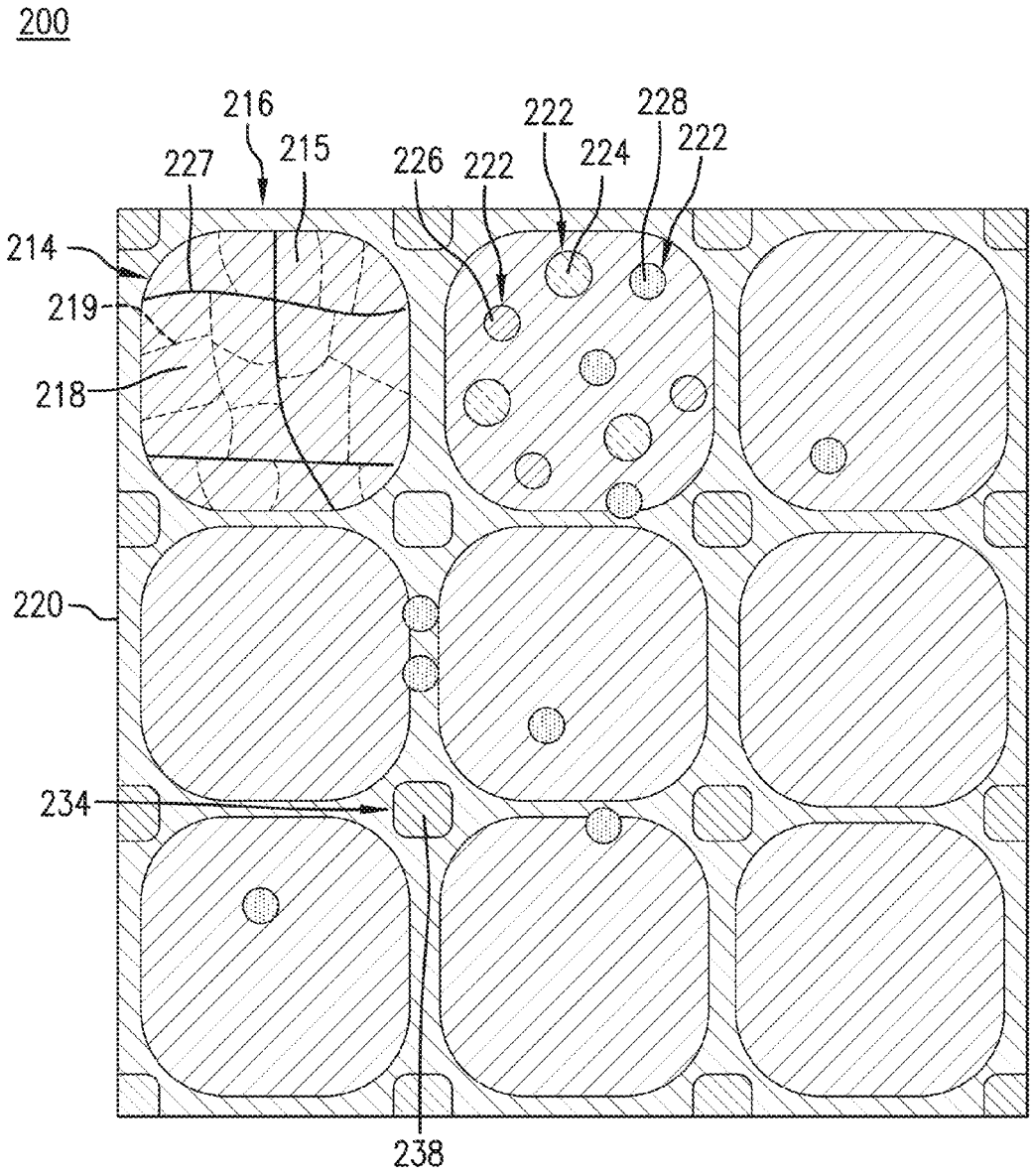
FIG. 6 depicts a cross sectional view of a disintegrable metal composite.

The metal composite/disintegrable material is, for example, a powder compact as shown in FIG. 6. According to FIG. 6, a metal composite 200 includes a cellular nanomatrix 216 comprising a nanomatrix material 220 and a metal matrix 214 (e.g., a plurality of dispersed particles) comprising a particle core material 218 dispersed in the cellular nanomatrix 216. The particle core material 218 comprises a nanostructured material. Such a metal composite having the cellular nanomatrix with metal matrix disposed therein is referred to as controlled electrolytic metallic material.

Figure 8:
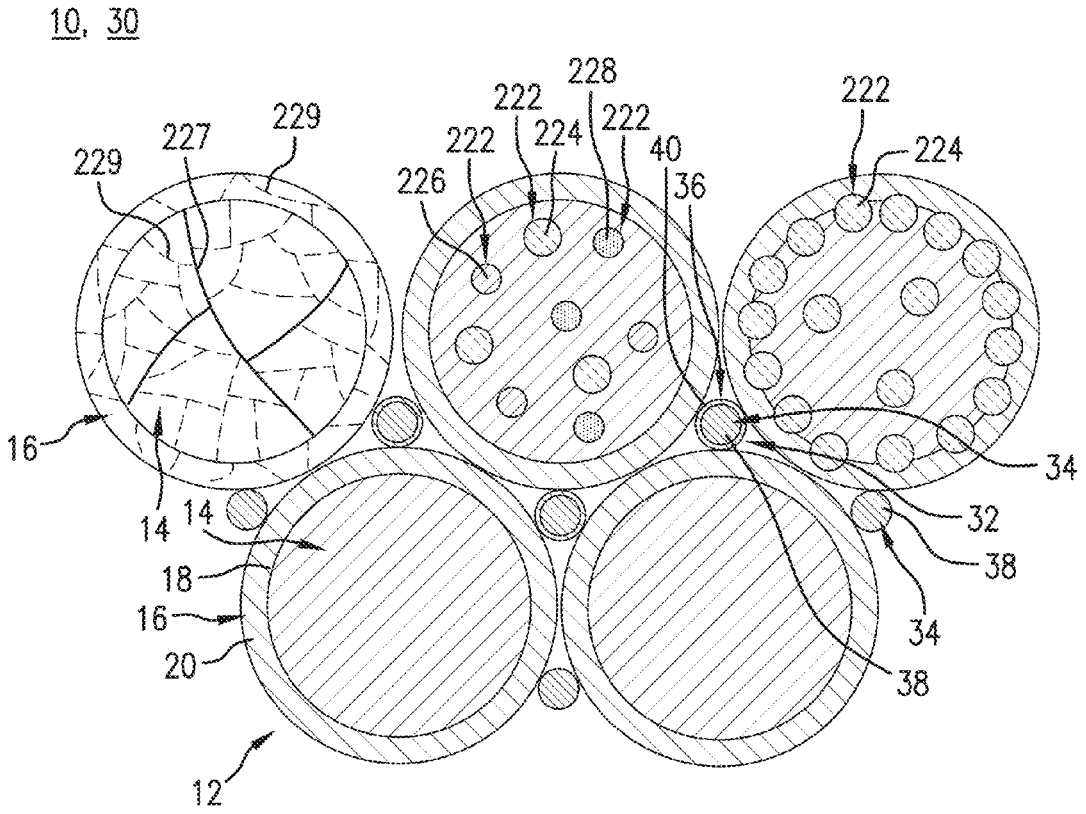
FIG. 8 depicts a cross sectional view of a composition used to make the disintegrable metal composite shown in FIG. 6.

With reference to FIGS. 6 and 8, metal matrix 214 can include any suitable metallic particle core material 218 that includes nanostructure as described herein. In an exemplary embodiment, the metal matrix 214 is formed from particle cores 14 (FIG. 8) and can include an element such as aluminum, iron, magnesium, manganese, zinc, or a combination thereof, as the nanostructured particle core material 218. More particularly, in an exemplary embodiment, the metal matrix 214 and particle core material 218 can include various Al or Mg alloys as the nanostructured particle core material 218, including various precipitation hardenable alloys Al or Mg alloys. In some embodiments, the particle core material 218 includes magnesium and aluminum where the aluminum is present in an amount of about 1 weight percent (wt %) to about 15 wt %, specifically about 1 wt % to about 10 wt %, and more specifically about 1 wt % to about 5 wt %, based on the weight of the metal matrix, the balance of the weight being magnesium.

In an additional embodiment, precipitation hardenable Al or Mg alloys are particularly useful because they can strengthen the metal matrix 214 through both nanostructuring and precipitation hardening through the incorporation of particle precipitates as described herein. The metal matrix 214 and particle core material 218 also can include a rare earth element, or a combination of rare earth elements. Exemplary rare earth elements include Sc, Y, La, Ce, Pr, Nd, or Er. A combination comprising at least one of the foregoing rare earth elements can be used. Where present, the rare earth element can be present in an amount of about 5 wt % or less, and specifically about 2 wt % or less, based on the weight of the metal composite.

The metal matrix 214 and particle core material 218 also can include a nanostructured material 215. In an exemplary embodiment, the nanostructured material 215 is a material having a grain size (e.g., a subgrain or crystallite size) that is less than about 200 nanometers (nm), specifically about 10 nm to about 200 nm, and more specifically an average grain size less than about 100 nm. The nanostructure of the metal matrix 214 can include high angle boundaries 227, which are usually used to define the grain size, or low angle boundaries 229 that may occur as substructure within a particular grain, which are sometimes used to define a crystallite size, or a combination thereof. It will be appreciated that the nanocellular matrix 216 and grain structure (nanostructured material 215 including grain boundaries 227 and 229) of the metal matrix 214 are distinct features of the metal composite 200. Particularly, nanocellular matrix 216 is not part of a crystalline or amorphous portion of the metal matrix 214.

The disintegration agent is included in the metal composite 200 to control the disintegration rate of the metal composite 200. The disintegration agent can be disposed in the metal matrix 214, the cellular nanomatrix 216, or a combination thereof. According to an embodiment, the disintegration agent includes a metal, fatty acid, ceramic particle, or a combination comprising at least one of the foregoing, the disintegration agent being disposed among the controlled electrolytic material to change the disintegration rate of the controlled electrolytic material. In one embodiment, the disintegration agent is disposed in the cellular nanomatrix external to the metal matrix. In a non-limiting embodiment, the disintegration agent increases the disintegration rate of the metal composite 200. In another embodiment, the disintegration agent decreases the disintegration rate of the metal composite 200. The disintegration agent can be a metal including cobalt, copper, iron, nickel, tungsten, zinc, or a combination comprising at least one of the foregoing. In a further embodiment, the disintegration agent is the fatty acid, e.g., fatty acids having 6 to 40 carbon atoms. Exemplary fatty acids include oleic acid, stearic acid, lauric acid, hyroxystearic acid, behenic acid, arachidonic acid, linoleic acid, linolenic acid, recinoleic acid, palmitic acid, montanic acid, or a combination comprising at least one of the foregoing. In yet another embodiment, the disintegration agent is ceramic particles such as boron nitride, tungsten carbide, tantalum carbide, titanium carbide, niobium carbide, zirconium carbide, boron carbide, hafnium carbide, silicon carbide, niobium boron carbide, aluminum nitride, titanium nitride, zirconium nitride, tantalum nitride, or a combination comprising at least one of the foregoing. Additionally, the ceramic particle can be one of the ceramic materials discussed below with regard to the strengthening agent. Such ceramic particles have a size of 5 μm or less, specifically 2 μm or less, and more specifically 1 μm or less. The disintegration agent can be present in an amount effective to cause disintegration of the metal composite 200 at a desired disintegration rate, specifically about 0.25 wt % to about 15 wt %, specifically about 0.25 wt % to about 10 wt %, specifically about 0.25 wt % to about 1 wt %, based on the weight of the metal composite.

In an exemplary embodiment, the cellular nanomatrix 216 includes aluminum, cobalt, copper, iron, magnesium, nickel, silicon, tungsten, zinc, an oxide thereof, a nitride thereof, a carbide thereof, an intermetallic compound thereof, a cermet thereof, or a combination comprising at least one of the foregoing. The metal matrix can be present in an amount from about 50 wt % to about 95 wt %, specifically about 60 wt % to about 95 wt %, and more specifically about 70 wt % to about 95 wt %, based on the weight of the seal. Further, the amount of the metal nanomatrix material is about 10 wt % to about 50 wt %, specifically about 20 wt % to about 50 wt %, and more specifically about 30 wt % to about 50 wt %, based on the weight of the seal.

In another embodiment, the metal composite includes a second particle. As illustrated generally in FIGS. 6 and 8, the metal composite 200 can be formed using a coated metallic powder 10 and an additional or second powder 30, i.e., both powders 10 and 30 can have substantially the same particulate structure without having identical chemical compounds. The use of an additional powder 30 provides a metal composite 200 that also includes a plurality of dispersed second particles 234, as described herein, that are dispersed within the cellular nanomatrix 216 and are also dispersed with respect to the metal matrix 214. Thus, the dispersed second particles 234 are derived from second powder particles 32 disposed in the powder 10, 30. In an exemplary embodiment, the dispersed second particles 234 include Ni, Fe, Cu, Co, W, Al, Zn, Mn, Si, an oxide thereof, nitride thereof, carbide thereof, intermetallic compound thereof, cermet thereof, or a combination comprising at least one of the foregoing.

Referring again to FIG. 6, the metal matrix 214 and particle core material 218 also can include an additive particle 222. The additive particle 222 provides a dispersion strengthening mechanism to the metal matrix 214 and provides an obstacle to, or serves to restrict, the movement of dislocations within individual particles of the metal matrix 214. Additionally, the additive particle 222 can be disposed in the cellular nanomatrix 216 to strengthen the metal composite 200. The additive particle 222 can have any suitable size and, in an exemplary embodiment, can have an average particle size of about 10 nm to about 1 micron, and specifically about 50 nm to about 200 nm. Here, size refers to the largest linear dimension of the additive particle. The additive particle 222 can include any suitable form of particle, including an embedded particle 224, a precipitate particle 226, or a dispersoid particle 228. Embedded particle 224 can include any suitable embedded particle, including various hard particles. The embedded particle can include various metal, carbon, metal oxide, metal nitride, metal carbide, intermetallic compound, cermet particle, or a combination thereof. In an exemplary embodiment, hard particles can include Ni, Fe, Cu, Co, W, Al, Zn, Mn, Si, an oxide thereof, nitride thereof, carbide thereof, intermetallic compound thereof, cermet thereof, or a combination comprising at least one of the foregoing. The additive particle can be present in an amount of about 0.5 wt % to about 25 wt %, specifically about 0.5 wt % to about 20 wt %, and more specifically about 0.5 wt % to about 10 wt %, based on the weight of the metal composite.

In metal composite 200, the metal matrix 214 dispersed throughout the cellular nanomatrix 216 can have an equiaxed structure in a substantially continuous cellular nanomatrix 216 or can be substantially elongated along an axis so that individual particles of the metal matrix 214 are oblately or prolately shaped, for example. In the case where the metal matrix 214 has substantially elongated particles, the metal matrix 214 and the cellular nanomatrix 216 may be continuous or discontinuous. The size of the particles that make up the metal matrix 214 can be from about 50 nm to about 800 μm, specifically about 500 nm to about 600 μm, and more specifically about 1 μm to about 500 μm. The particle size of can be monodisperse or polydisperse, and the particle size distribution can be unimodal or bimodal. Size here refers to the largest linear dimension of a particle.

Figure 7:
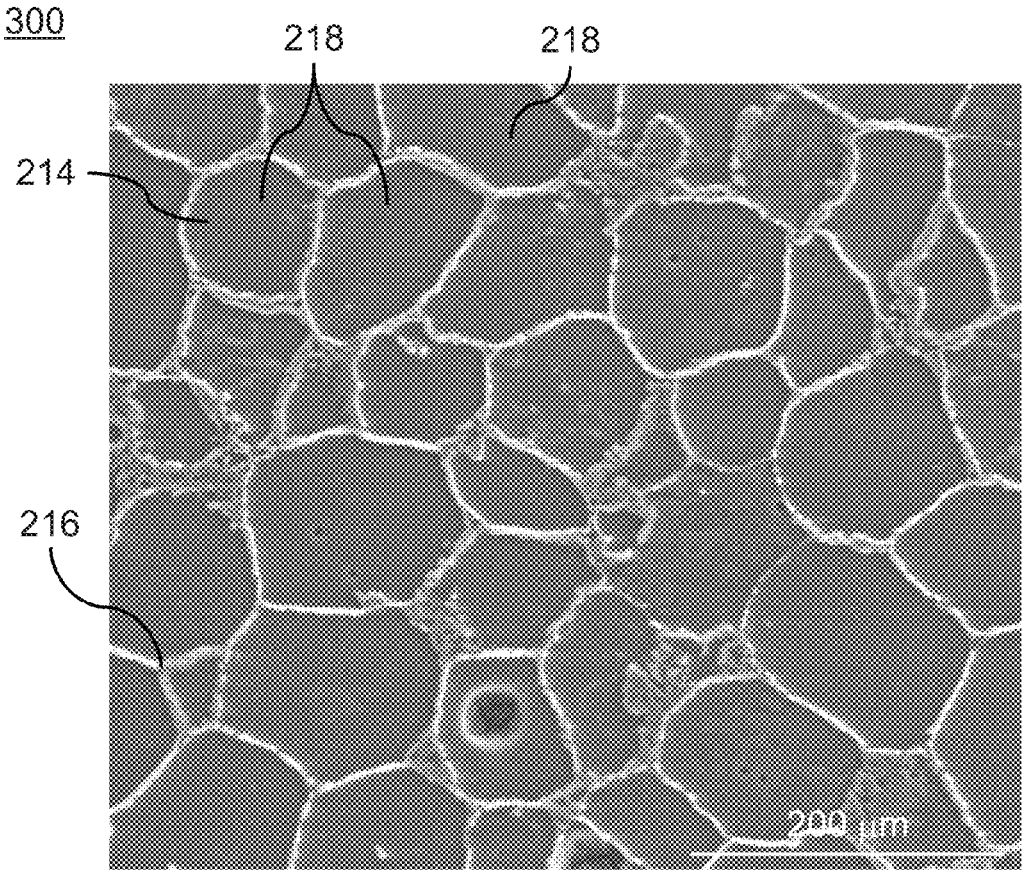
FIG. 7 is a photomicrograph of an exemplary embodiment of a disintegrable metal composite as disclosed herein.

Referring to FIG. 7 a photomicrograph of an exemplary embodiment of a metal composite is shown. The metal composite 300 has a metal matrix 214 that includes particles having a particle core material 218. Additionally, each particle of the metal matrix 214 is disposed in a cellular nanomatrix 216. Here, the cellular nanomatrix 216 is shown as a white network that substantially surrounds the component particles of the metal matrix 214.

According to an embodiment, the metal composite is formed from a combination of, for example, powder constituents. As illustrated in FIG. 8, a powder 10 includes powder particles 12 that have a particle core 14 with a core material 18 and metallic coating layer 16 with coating material 20. These powder constituents can be selected and configured for compaction and sintering to provide the metal composite 200 that is lightweight (i.e., having a relatively low density), high-strength, and selectably and controllably removable, e.g., by disintegration, from a borehole in response to a change in a borehole property, including being selectably and controllably disintegrable (e.g., by having a selectively tailorable disintegration rate curve) in an appropriate borehole fluid, including various borehole fluids as disclosed herein.

The nanostructure can be formed in the particle core 14 used to form metal matrix 214 by any suitable method, including a deformation-induced nanostructure such as can be provided by ball milling a powder to provide particle cores 14, and more particularly by cryomilling (e.g., ball milling in ball milling media at a cryogenic temperature or in a cryogenic fluid, such as liquid nitrogen) a powder to provide the particle cores 14 used to form the metal matrix 214. The particle cores 14 may be formed as a nanostructured material 215 by any suitable method, such as, for example, by milling or cryomilling of prealloyed powder particles of the materials described herein. The particle cores 14 may also be formed by mechanical alloying of pure metal powders of the desired amounts of the various alloy constituents. Mechanical alloying involves ball milling, including cryomilling, of these powder constituents to mechanically enfold and intermix the constituents and form particle cores 14. In addition to the creation of nanostructure as described above, ball milling, including cryomilling, can contribute to solid solution strengthening of the particle core 14 and core material 18, which in turn can contribute to solid solution strengthening of the metal matrix 214 and particle core material 218. The solid solution strengthening can result from the ability to mechanically intermix a higher concentration of interstitial or substitutional solute atoms in the solid solution than is possible in accordance with the particular alloy constituent phase equilibria, thereby providing an obstacle to, or serving to restrict, the movement of dislocations within the particle, which in turn provides a strengthening mechanism in the particle core 14 and the metal matrix 214. The particle core 14 can also be formed with a nanostructure (grain boundaries 227, 229) by methods including inert gas condensation, chemical vapor condensation, pulse electron deposition, plasma synthesis, crystallization of amorphous solids, electrodeposition, and severe plastic deformation, for example. The nanostructure also can include a high dislocation density, such as, for example, a dislocation density between about $10^{17}$ $m^{-2}$ and about $10^{18}$ $m^{-2}$, which can be two to three orders of magnitude higher than similar alloy materials deformed by traditional methods, such as cold rolling.

The substantially-continuous cellular nanomatrix 216 (see FIG. 7) and nanomatrix material 220 formed from metallic coating layers 16 by the compaction and sintering of the plurality of metallic coating layers 16 with the plurality of powder particles 12, such as by cold isostatic pressing (CIP), hot isostatic pressing (HIP), or dynamic forging. The chemical composition of nanomatrix material 220 may be different than that of coating material 20 due to diffusion effects associated with the sintering. The metal composite 200 also includes a plurality of particles that make up the metal matrix 214 that comprises the particle core material 218. The metal matrix 214 and particle core material 218 correspond to and are formed from the plurality of particle cores 14 and core material 18 of the plurality of powder particles 12 as the metallic coating layers 16 are sintered together to form the cellular nanomatrix 216. The chemical composition of particle core material 218 may also be different than that of core material 18 due to diffusion effects associated with sintering.

As used herein, the term cellular nanomatrix 216 does not connote the major constituent of the powder compact, but rather refers to the minority constituent or constituents, whether by weight or by volume. This is distinguished from most matrix composite materials where the matrix comprises the majority constituent by weight or volume. The use of the term substantially continuous, cellular nanomatrix is intended to describe the extensive, regular, continuous and interconnected nature of the distribution of nanomatrix material 220 within the metal composite 200. As used herein, "substantially continuous" describes the extension of the nanomatrix material 220 throughout the metal composite 200 such that it extends between and envelopes substantially all of the metal matrix 214. Substantially continuous is used to indicate that complete continuity and regular order of the cellular nanomatrix 220 around individual particles of the metal matrix 214 are not required. For example, defects in the coating layer 16 over particle core 14 on some powder particles 12 may cause bridging of the particle cores 14 during sintering of the metal composite 200, thereby causing localized discontinuities to result within the cellular nanomatrix 216, even though in the other portions of the powder compact the cellular nanomatrix 216 is substantially continuous and exhibits the structure described herein. In contrast, in the case of substantially elongated particles of the metal matrix 214 (i.e., non-equiaxed shapes), such as those formed by extrusion, "substantially discontinuous" is used to indicate that incomplete continuity and disruption (e.g., cracking or separation) of the nanomatrix around each particle of the metal matrix 214, such as may occur in a predetermined extrusion direction. As used herein, "cellular" is used to indicate that the nanomatrix defines a network of generally repeating, interconnected, compartments or cells of nanomatrix material 220 that encompass and also interconnect the metal matrix 214. As used herein, "nanomatrix" is used to describe the size or scale of the matrix, particularly the thickness of the matrix between adjacent particles of the metal matrix 214. The metallic coating layers that are sintered together to form the nanomatrix are themselves nanoscale thickness coating layers. Since the cellular nanomatrix 216 at most locations, other than the intersection of more than two particles of the metal matrix 214, generally comprises the interdiffusion and bonding of two coating layers 16 from adjacent powder particles 12 having nanoscale thicknesses, the cellular nanomatrix 216 formed also has a nanoscale thickness (e.g., approximately two times the coating layer thickness as described herein) and is thus described as a nanomatrix. Further, the use of the term metal matrix 214 does not connote the minor constituent of metal composite 200, but rather refers to the majority constituent or constituents, whether by weight or by volume. The use of the term metal matrix is intended to convey the discontinuous and discrete distribution of particle core material 218 within metal composite 200.

Embedded particle 224 can be embedded by any suitable method, including, for example, by ball milling or cryomilling hard particles together with the particle core material 18. A precipitate particle 226 can include any particle that can be precipitated within the metal matrix 214, including precipitate particles 226 consistent with the phase equilibria of constituents of the materials, particularly metal alloys, of interest and their relative amounts (e.g., a precipitation hardenable alloy), and including those that can be precipitated due to non-equilibrium conditions, such as may occur when an alloy constituent that has been forced into a solid solution of the alloy in an amount above its phase equilibrium limit, as is known to occur during mechanical alloying, is heated sufficiently to activate diffusion mechanisms that enable precipitation. Dispersoid particles 228 can include nanoscale particles or clusters of elements resulting from the manufacture of the particle cores 14, such as those associated with ball milling, including constituents of the milling media (e.g., balls) or the milling fluid (e.g., liquid nitrogen) or the surfaces of the particle cores 14 themselves (e.g., metallic oxides or nitrides). Dispersoid particles 228 can include an element such as, for example, Fe, Ni, Cr, Mn, N, O, C, H, and the like. The additive particles 222 can be disposed anywhere in conjunction with particle cores 14 and the metal matrix 214. In an exemplary embodiment, additive particles 222 can be disposed within or on the surface of metal matrix 214 as illustrated in FIG. 6. In another exemplary embodiment, a plurality of additive particles 222 are disposed on the surface of the metal matrix 214 and also can be disposed in the cellular nanomatrix 216 as illustrated in FIG. 6.

Similarly, dispersed second particles 234 may be formed from coated or uncoated second powder particles 32 such as by dispersing the second powder particles 32 with the powder particles 12. In an exemplary embodiment, coated second powder particles 32 may be coated with a coating layer 36 that is the same as coating layer 16 of powder particles 12, such that coating layers 36 also contribute to the nanomatrix 216. In another exemplary embodiment, the second powder particles 232 may be uncoated such that dispersed second particles 234 are embedded within nanomatrix 216. The powder 10 and additional powder 30 may be mixed to form a homogeneous dispersion of dispersed particles 214 and dispersed second particles 234 or to form a non-homogeneous dispersion of these particles. The dispersed second particles 234 may be formed from any suitable additional powder 30 that is different from powder 10, either due to a compositional difference in the particle core 34, or coating layer 36, or both of them, and may include any of the materials disclosed herein for use as second powder 30 that are different from the powder 10 that is selected to form powder compact 200.

In an embodiment, the metal composite optionally includes a strengthening agent. The strengthening agent increases the material strength of the metal composite. Exemplary strengthening agents include a ceramic, polymer, metal, nanoparticles, cermet, and the like. In particular, the strengthening agent can be silica, glass fiber, carbon fiber, carbon black, carbon nanotubes, borides, oxides, carbides, nitrides, silicides, borides, phosphides, sulfides, cobalt, nickel, iron, tungsten, molybdenum, tantalum, titanium, chromium, niobium, boron, zirconium, vanadium, silicon, palladium, hafnium, aluminum, copper, or a combination comprising at least one of the foregoing. According to an embodiment, a ceramic and metal is combined to form a cermet, e.g., tungsten carbide, cobalt nitride, and the like. Exemplary strengthening agents particularly include magnesia, mullite, thoria, beryllia, urania, spinels, zirconium oxide, bismuth oxide, aluminum oxide, magnesium oxide, silica, barium titanate, cordierite, boron nitride, tungsten carbide, tantalum carbide, titanium carbide, niobium carbide, zirconium carbide, boron carbide, hafnium carbide, silicon carbide, niobium boron carbide, aluminum nitride, titanium nitride, zirconium nitride, tantalum nitride, hafnium nitride, niobium nitride, boron nitride, silicon nitride, titanium boride, chromium boride, zirconium boride, tantalum boride, molybdenum boride, tungsten boride, cerium sulfide, titanium sulfide, magnesium sulfide, zirconium sulfide, or a combination comprising at least one of the foregoing. Non-limiting examples of strengthening agent polymers include polyurethanes, polyimides, polycarbonates, and the like.

In one embodiment, the strengthening agent is a particle with size of about 100 microns or less, specifically about 10 microns or less, and more specifically 500 nm or less. In another embodiment, a fibrous strengthening agent can be combined with a particulate strengthening agent. It is believed that incorporation of the strengthening agent can increase the strength and fracture toughness of the metal composite. Without wishing to be bound by theory, finer (i.e., smaller) sized particles can produce a stronger metal composite as compared with larger sized particles. Moreover, the shape of strengthening agent can vary and includes fiber, sphere, rod, tube, and the like. The strengthening agent can be present in an amount of 0.01 weight percent (wt %) to 20 wt %, specifically 0.01 wt % to 10 wt %, and more specifically 0.01 wt % to 5 wt %.

In a process for preparing a component of a disintegrable anchoring system (e.g., a seal, frustoconical member, sleeve, bottom sub, and the like) containing a metal composite, the process includes combining a metal matrix powder, disintegration agent, metal nanomatrix material, and optionally a strengthening agent to form a composition; compacting the composition to form a compacted composition; sintering the compacted composition; and pressing the sintered composition to form the component of the disintegrable system. The members of the composition can be mixed, milled, blended, and the like to form the powder 10 as shown in FIG. 8 for example. It should be appreciated that the metal nanomatrix material is a coating material disposed on the metal matrix powder that, when compacted and sintered, forms the cellular nanomatrix. A compact can be formed by pressing (i.e., compacting) the composition at a pressure to form a green compact. The green compact can be subsequently pressed under a pressure of about 15,000 psi to about 100,000 psi, specifically about 20,000 psi to about 80,000 psi, and more specifically about 30,000 psi to about 70,000 psi, at a temperature of about 250° C. to about 600° C., and specifically about 300° C. to about 450° C., to form the powder compact. Pressing to form the powder compact can include compression in a mold. The powder compact can be further machined to shape the powder compact to a useful shape. Alternatively, the powder compact can be pressed into the useful shape. Machining can include cutting, sawing, ablating, milling, facing, lathing, boring, and the like using, for example, a mill, table saw, lathe, router, electric discharge machine, and the like.

The metal matrix 200 can have any desired shape or size, including that of a cylindrical billet, bar, sheet, toroid, or other form that may be machined, formed or otherwise used to form useful articles of manufacture, including various wellbore tools and components. Pressing is used to form a component of the disintegrable anchoring system (e.g., seal, frustoconical member, sleeve, bottom sub, and the like) from the sintering and pressing processes used to form the metal composite 200 by deforming the powder particles 12, including particle cores 14 and coating layers 16, to provide the full density and desired macroscopic shape and size of the metal composite 200 as well as its microstructure. The morphology (e.g. equiaxed or substantially elongated) of the individual particles of the metal matrix 214 and cellular nanomatrix 216 of particle layers results from sintering and deformation of the powder particles 12 as they are compacted and interdiffuse and deform to fill the interparticle spaces of the metal matrix 214 (FIG. 6). The sintering temperatures and pressures can be selected to ensure that the density of the metal composite 200 achieves substantially full theoretical density.

The metal composite has beneficial properties for use in, for example a downhole environment. In an embodiment, a component of the disintegrable anchoring system made of the metal composite has an initial shape that can be run downhole and, in the case of the seal and sleeve, can be subsequently deformed under pressure. The metal composite is strong and ductile with a percent elongation of about 0.1% to about 75%, specifically about 0.1% to about 50%, and more specifically about 0.1% to about 25%, based on the original size of the component of the disintegrable anchoring system. The metal composite has a yield strength of about 15 kilopounds per square inch (ksi) to about 50 ksi, and specifically about 15 ksi to about 45 ksi. The compressive strength of the metal composite is from about 30 ksi to about 100 ksi, and specifically about 40 ksi to about 80 ksi. The components of the disintegrable anchoring system can have the same or different material properties, such as percent elongation, compressive strength, tensile strength, and the like.

Unlike elastomeric materials, the components of the disintegrable anchoring system herein that include the metal composite have a temperature rating up to about 1200° F., specifically up to about 1000° F., and more specifically about 800° F. The disintegrable anchoring system is temporary in that the system is selectively and tailorably disintegrable in response to contact with a downhole fluid or change in condition (e.g., pH, temperature, pressure, time, and the like). Moreover, the components of the disintegrable anchoring system can have the same or different disintegration rates or reactivities with the downhole fluid. Exemplary downhole fluids include brine, mineral acid, organic acid, or a combination comprising at least one of the foregoing. The brine can be, for example, seawater, produced water, completion brine, or a combination thereof. The properties of the brine can depend on the identity and components of the brine. Seawater, as an example, contains numerous constituents such as sulfate, bromine, and trace metals, beyond typical halide-containing salts. On the other hand, produced water can be water extracted from a production reservoir (e.g., hydrocarbon reservoir), produced from the ground. Produced water is also referred to as reservoir brine and often contains many components such as barium, strontium, and heavy metals. In addition to the naturally occurring brines (seawater and produced water), completion brine can be synthesized from fresh water by addition of various salts such as KCl, NaCl, $ZnCl_2$, $MgCl_2$, or $CaCl_2$ to increase the density of the brine, such as 10.6 pounds per gallon of $CaCl_2$ brine. Completion brines typically provide a hydrostatic pressure optimized to counter the reservoir pressures downhole. The above brines can be modified to include an additional salt. In an embodiment, the additional salt included in the brine is NaCl, KCl, NaBr, $MgCl_2$, $CaCl_2$, $CaBr_2$, $ZnBr_2$, $NH_4Cl$, sodium formate, cesium formate, and the like. The salt can be present in the brine in an amount from about 0.5 wt. % to about 50 wt. %, specifically about 1 wt. % to about 40 wt. %, and more specifically about 1 wt. % to about 25 wt. %, based on the weight of the composition.

In another embodiment, the downhole fluid is a mineral acid that can include hydrochloric acid, nitric acid, phosphoric acid, sulfuric acid, boric acid, hydrofluoric acid, hydrobromic acid, perchloric acid, or a combination comprising at least one of the foregoing. In yet another embodiment, the downhole fluid is an organic acid that can include a carboxylic acid, sulfonic acid, or a combination comprising at least one of the foregoing. Exemplary carboxylic acids include formic acid, acetic acid, chloroacetic acid, dichloroacetic acid, trichloroacetic acid, trifluoroacetic acid, proprionic acid, butyric acid, oxalic acid, benzoic acid, phthalic acid (including ortho-, meta- and para-isomers), and the like. Exemplary sulfonic acids include alkyl sulfonic acid or aryl sulfonic acid. Alkyl sulfonic acids include, e.g., methane sulfonic acid. Aryl sulfonic acids include, e.g., benzene sulfonic acid or toluene sulfonic acid. In one embodiment, the alkyl group may be branched or unbranched and may contain from one to about 20 carbon atoms and can be substituted or unsubstituted. The aryl group can be alkyl-substituted, i.e., may be an alkylaryl group, or may be attached to the sulfonic acid moiety via an alkylene group (i.e., an arylalkyl group). In an embodiment, the aryl group may be substituted with a heteroatom. The aryl group can have from about 3 carbon atoms to about 20 carbon atoms and include a polycyclic ring structure.

The disintegration rate (also referred to as dissolution rate) of the metal composite is about 1 milligram per square centimeter per hour ($mg/cm^2/hr$) to about 10,000 $mg/cm^2/hr$, specifically about 25 $mg/cm^2/hr$ to about 1000 $mg/cm^2/hr$, and more specifically about 50 $mg/cm^2/hr$ to about 500 $mg/cm^2/hr$. The disintegration rate is variable upon the composition and processing conditions used to form the metal composite herein.

Figure 9A:
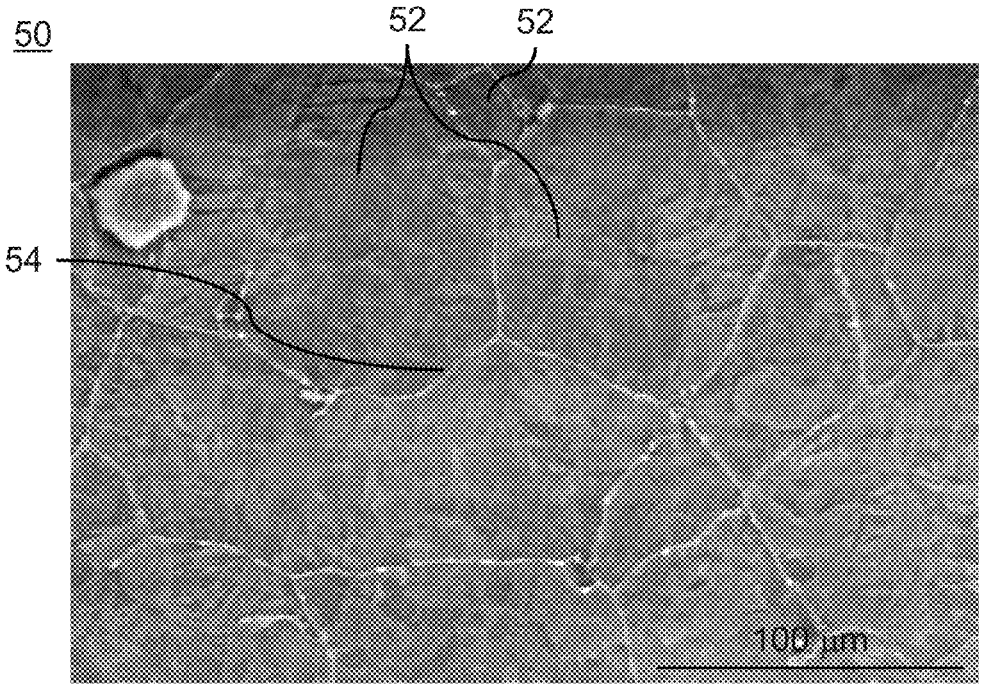
FIG. 9A is a photomicrograph of a pure metal without a cellular nanomatrix.
Figure 9B:
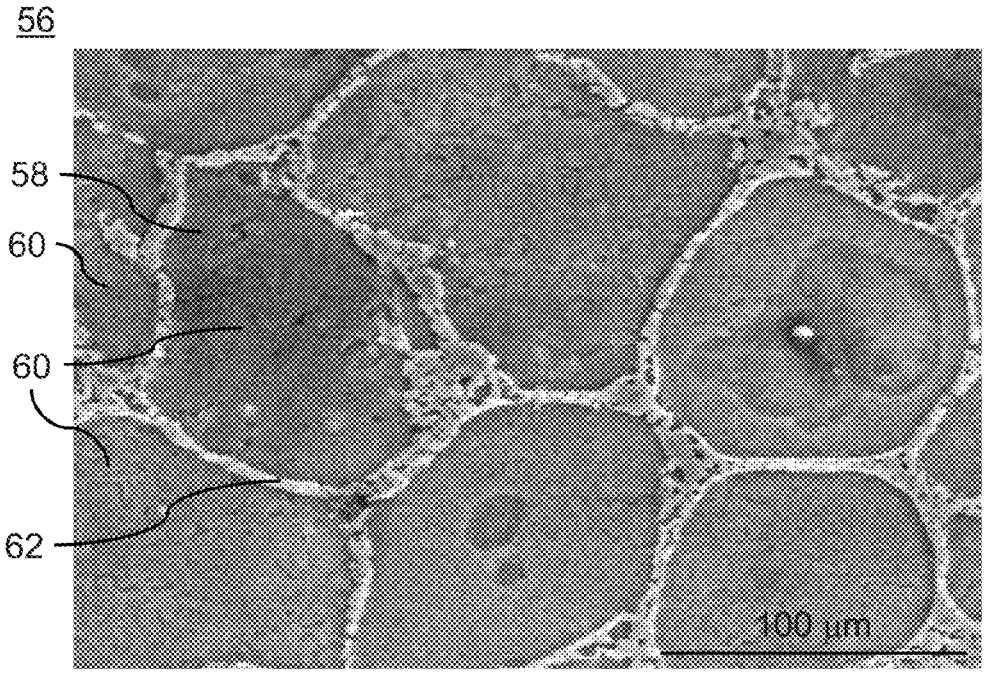
FIG. 9B is a photomicrograph of a disintegrable metal composite with a metal matrix and cellular nanomatrix.

Without wishing to be bound by theory, the unexpectedly high disintegration rate of the metal composite herein is due to the microstructure provided by the metal matrix and cellular nanomatrix. As discussed above, such microstructure is provided by using powder metallurgical processing (e.g., compaction and sintering) of coated powders, wherein the coating produces the nanocellular matrix and the powder particles produce the particle core material of the metal matrix. It is believed that the intimate proximity of the cellular nanomatrix to the particle core material of the metal matrix in the metal composite produces galvanic sites for rapid and tailorable disintegration of the metal matrix. Such electrolytic sites are missing in single metals and alloys that lack a cellular nanomatrix. For illustration, FIG. 9A shows a compact 50 formed from magnesium powder. Although the compact 50 exhibits particles 52 surrounded by particle boundaries 54, the particle boundaries constitute physical boundaries between substantially identical material (particles 52). However, FIG. 9B shows an exemplary embodiment of a composite metal 56 (a powder compact) that includes a metal matrix 58 having particle core material 60 disposed in a cellular nanomatrix 62. The composite metal 56 was formed from aluminum oxide coated magnesium particles where, under powder metallurgical processing, the aluminum oxide coating produces the cellular nanomatrix 62, and the magnesium produces the metal matrix 58 having particle core material 60 (of magnesium). Cellular nanomatrix 62 is not just a physical boundary as the particle boundary 54 in FIG. 9A but is also a chemical boundary interposed between neighboring particle core materials 60 of the metal matrix 58. Whereas the particles 52 and particle boundary 54 in compact 50 (FIG. 9A) do not have galvanic sites, metal matrix 58 having particle core material 60 establish a plurality of galvanic sites in conjunction with the cellular nanomatrix 62. The reactivity of the galvanic sites depend on the compounds used in the metal matrix 58 and the cellular nanomatrix 62 as is an outcome of the processing conditions used to the metal matrix and cellular nanomatrix microstructure of the metal composite.

Not only does the microstructure of the metal composite govern the disintegration rate behavior of the metal composite but also affects the strength and ductility of the metal composite. As a consequence, the metal composites herein also have a selectively tailorable material strength yield (and other material properties), in which the material strength yield varies due to the processing conditions and the materials used to produce the metal composite. That is, the microstructural morphology of the substantially continuous, cellular nanomatrix, which can be selected to provide a strengthening phase material, with the metal matrix (having particle core material), provides the metal composites herein with enhanced mechanical properties, including compressive strength and sheer strength, since the resulting morphology of the cellular nanomatrix/metal matrix can be manipulated to provide strengthening through the processes that are akin to traditional strengthening mechanisms, such as grain size reduction, solution hardening through the use of impurity atoms, precipitation or age hardening and strain/work hardening mechanisms. The cellular nanomatrix/metal matrix structure tends to limit dislocation movement by virtue of the numerous particle nanomatrix interfaces, as well as interfaces between discrete layers within the cellular nanomatrix material as described herein. Because the above-discussed materials have high-strength characteristics, the core material and coating material may be selected to utilize low density materials or other low density materials, such as low-density metals, ceramics, glasses or carbon, that otherwise would not provide the necessary strength characteristics for use in the desired applications, e.g., centralization, stabilization, deformation, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A system comprising:

a mill;

an outer casing disposed radially adjacent to the mill; and a centralizer disposed between the mill and the outer casing, the centralizer comprising one or more deformable elements that radially extend under axial compression, the centralizer formed at least partially from a disintegrable material responsive to a selected fluid; wherein the centralizer is operatively arranged to transition from a first set of dimensions suitable for running the centralizer into a desired location to a second set of dimensions that is radially expanded with respect to the first set, and wherein the mill is operatively arranged to assist in transitioning the centralizer from the first set of dimensions to the second set of dimensions.

2. The system of claim 1, wherein the one or more deformable elements are spring-like and the centralizer resiliently transition between the first and second set of dimensions.

3. The system of claim 1, wherein the centralizer is axially compressed by an actuator.

4. The system of claim 3, wherein the actuator includes a pressurizable chamber.

5. The system of claim 1, wherein the centralizer is axially compressed against a shoulder of the mill while transitioning between the first and second set of dimensions.

6. The system of claim 1, wherein the degradable material is a metal composite including:

a cellular nanomatrix comprising a metallic nanomatrix material;

a metal matrix disposed in the cellular nanomatrix; and a disintegration agent.

7. The system of claim 6, wherein the centralizer has a disintegration rate tailorable between about 1 $mg/cm^2/hr$ to about 10,000 $mg/cm^2/hr$.

8. A method of completing a borehole comprising:

disposing a centralizer between a mill and an outer casing, the centralizer comprising one or more deformable elements that radially extend under axial compression;

axially compressing the centralizer to reduce a radial gap between the mill and the outer casing;

milling the outer casing with the mill and stabilizing the mill with the centralizer; and, disintegrating the centralizer by exposure to a selected fluid.

9. The method of claim 8, further comprising transitioning the centralizer from a first set of dimensions to a second set of dimensions that are radially expanded with respect to the first set.

* * * * *